US007403631B2

(12) United States Patent
Sawamoto et al.

(10) Patent No.: US 7,403,631 B2
(45) Date of Patent: Jul. 22, 2008

(54) ELECTRO-ACOUSTIC TRANSDUCER

(75) Inventors: Norihiro Sawamoto, Shizuoka (JP); Hiromi Yamada, Shizuoka (JP); Yoshio Imahori, Shizuoka (JP); Yasunori Tsukuda, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 557 days.

(21) Appl. No.: 11/045,094

(22) Filed: Jan. 31, 2005

(65) Prior Publication Data

US 2005/0181659 A1 Aug. 18, 2005

(30) Foreign Application Priority Data

Feb. 5, 2004 (JP) ..... P2004-029605

(51) Int. Cl.
*H04R 25/00* (2006.01)

(52) U.S. Cl. ..... 381/396; 381/409; 381/410

(58) Field of Classification Search ..... 439/733.1; 340/388.8, 390.2, 391.1; 379/433.02, 433.03, 379/434; 381/71.7, 162, 189, 190, 324, 334, 381/335, 344, 345, 355, 361, 365, 369, 385, 381/386, 394, 395, 396, 400, 409, 410, 412
See application file for complete search history.

(56) References Cited

U.S. PATENT DOCUMENTS 5,995,637 A 11/1999 Petersen et al.
6,704,430 B2 * 3/2004 Imahori et al. ..... 381/396
6,904,155 B2 * 6/2005 Yonehara et al. ..... 381/409

FOREIGN PATENT DOCUMENTS

JP 2004-7305 A 1/2004

* cited by examiner

*Primary Examiner*—Brian Ensey
(74) *Attorney, Agent, or Firm*—Sughrue Mion, PLLC

(57) ABSTRACT

The two coil spring terminals have the structure of double coil spring terminal including a small diameter coil spring terminal and a large diameter coil spring terminal. In this case, a terminal holder is provided with a clamping portion for clamping the large diameter coil spring terminal between the terminal holder and an internal circuit board. Specifically, the terminal holder is formed, in an upper end portion of its outer peripheral surface, with an annular groove which is adapted to be engaged with a small diameter portion formed in an upper end portion of the large diameter coil spring terminal. This omits fixation of the large diameter coil spring terminal to the internal circuit board, and necessity of soldering the two coil spring terminals respectively to the internal circuit board as a conventional art, enhancing mounting workability of the terminal holder.

10 Claims, 4 Drawing Sheets

ELECTRO-ACOUSTIC TRANSDUCER

BACKGROUND OF THE INVENTION

1. Field of the Invention

The present invention relates to an electro-acoustic transducer which is configured so as to be mounted on an external circuit board.

2. Description of the Related Art

Generally, there are many electro-acoustic transducers such as a miniature microphone, speaker, etc. which are configured so as to be mounted on an external circuit board (that is, a circuit board of an external apparatus).

For example, JP-A-2004-7305 discloses an electro-acoustic transducer in which a terminal holder for holding two coil spring terminals is mounted to an internal circuit board inside a transducer body. On occasion of mounting this electro-acoustic transducer on the external circuit board, the coil spring terminals are elastically compressed and deformed thereby permitting the internal circuit board to be conductive with the external circuit board.

In the electro-acoustic transducer disclosed in JP-A-2004-7305, the two coil spring terminals are designed as a double coil spring terminal which includes a small diameter coil spring terminal and a large diameter coil spring terminal arranged in a manner of surrounding the small diameter coil spring terminal.

SUMMARY OF THE INVENTION

By employing the electro-acoustic transducer having such structure of the double coil spring terminal, it is possible to mount the electro-acoustic transducer on the external circuit board with no regard to its position in a rotational direction.

However, in the electro-acoustic transducer disclosed in the above described JP-A-2004-7305, the terminal holder is mounted to the internal circuit board by soldering the two coil spring terminals one by one to the internal circuit board, and therefore, there has been the following problem.

Specifically, soldering of these coil spring terminals to the internal circuit board has been conducted in a state where pin-shaped projections which are formed on respective end portions of the coil spring terminals on a side of the internal circuit board have been inserted into through holes which are respectively formed in the terminal holder and the internal circuit board. On this occasion, the through holes formed at two positions of the terminal holder and the through holes formed at two positions of the internal circuit board must be aligned, and in this state, the coil spring terminals must be respectively inserted into these through holes. Therefore, the problem is that mounting workability of the terminal holder is not good.

The present invention has been made in view of such circumstances, and it is an object of the invention to provide an electro-acoustic transducer in which a terminal holder for holding two coil spring terminals is mounted to an internal circuit board inside a transducer body, wherein the terminal holder can be easily mounted, even in case where a structure of double coil spring terminal is employed.

According to the present invention, the above described object can be attained by forming a predetermined clamping portion in the terminal holder.

According to an embodiment of the present invention, there is provided an electro-acoustic transducer configured so as to be mounted on an external circuit board, including: a transducer body having an internal circuit board; coil spring terminals disposed in a manner contactable with a conductive portion of the internal circuit board; and a terminal holder mounted to the internal circuit board so as to hold the coil spring terminals, wherein the electro-acoustic transducer is configured so that the coil spring terminals are elastically compressed and deformed for permitting the internal circuit board to be conductive with the external circuit board when the transducer is mounted on the external circuit board, the coil spring terminals include: a small diameter coil spring terminal; and a large diameter coil spring terminal arranged in a manner of surrounding the small diameter coil spring terminal, and the terminal holder is provided with at least one clamping portion for clamping one of the coil spring terminals between the terminal holder and the internal circuit board.

The electro-acoustic transducer is not limited to a particular type, but a speaker, buzzer, microphone, receiver, etc. can be employed.

The terminal holder is so designed as to be mounted to the internal circuit board. As a specific structure of mounting it to the internal circuit board, the terminal holder may be directly mounted or may be mounted by way of other members.

The two coil spring terminals are not particularly limited in their specific structures and arrangements, provided that the large diameter coil spring terminal is arranged in a manner of surrounding the small diameter coil spring terminal. Moreover, these two coil spring terminals need not be necessarily in contact with the electrically conductive portion of the internal circuit board in a stage prior to mounting the electro-acoustic transducer on the external circuit board, provided that they are so arranged in a manner contactable with the electrically conductive portion.

The clamping portion is not particularly limited in its specific structure, provided that the clamping portion is configured in such a manner that at least one of the two coil spring terminals can be clamped between the terminal holder and the internal circuit board.

The electro-acoustic transducer according to an embodiment of the invention is configured so that the terminal holder for holding the two coil spring terminals is mounted to the internal circuit board inside the transducer body. Because the two coil spring terminals are designed as the structure of multiple coil spring terminal, it is possible to mount the electro-acoustic transducer on the external circuit board, with no regard to the position of the electro-acoustic transducer in a rotational direction.

Moreover, in the electro-acoustic transducer according to an embodiment of the invention, the terminal holder is provided with at least one clamping portion for clamping at least one of the two coil spring terminals between the terminal holder and the internal circuit board, and therefore, at least one of the coil spring terminals need not be fixed to the internal circuit board. As the results, necessity of fixing the two coil spring terminals to the internal circuit board one by one by soldering as a conventional art can be omitted. Accordingly, it will not be necessary to insert the coil spring terminals in the state where the through holes formed at the two positions on the terminal holder and the through holes formed at the two positions on the internal circuit board have been aligned, and mounting workability of the terminal holder can be enhanced.

As described, according to the invention, in the electro-acoustic transducer wherein the terminal holder for holding a plurality of the coil spring terminals is mounted to the internal circuit board inside the transducer body, mounting of the terminal holder can be easily conducted, even in case where the structure of double coil spring terminal is employed.

In the above described structure, an annular groove may be formed as the clamping portion, on an outer peripheral surface of the terminal holder at an end on a side of the internal circuit board, and an end portion of the large diameter coil spring terminal on the side of the internal circuit board may be formed as a small diameter portion which has a smaller winding diameter than other portions of the large diameter coil spring terminal, so as to be engaged with this annular groove. In this manner, it is possible to reliably hold the large diameter coil spring terminal with a simple structure.

In this case, the end portion of the large diameter coil spring terminal on the side of the internal circuit board may be designed as including only the small diameter portion. However, by forming the double wound winding structure having a winding portion which has a larger diameter than the diameter of the annular groove, on the outer circumference of the small diameter portion, the end portion of the large diameter coil spring terminal on the side of the internal circuit board can be engaged with the annular groove without strain.

Moreover, in the above described structure, the terminal holder and the internal circuit board may be formed with through holes respectively, and the small diameter coil spring terminal may be provided, at its end portion on the side of the internal circuit board, with a pin-shaped projection projecting toward the internal circuit board. By fixing this pin-shaped projection by soldering to the internal circuit board in a state inserted into the two through holes, the terminal holder can be reliably fixed by conducting a soldering work at one position.

In this case, the terminal insertion recess into which the small diameter coil spring terminal is inserted and disposed may be formed in the end portion of the terminal holder on an opposite side to the internal circuit board so as to be communicated with the through hole of the terminal holder. In this manner, it is possible to prevent the small diameter coil spring terminal from falling accidentally, when the transducer is mounted on the external circuit board.

On the other hand, in the above described structure, the internal circuit board may be formed with at least one through hole, and the terminal holder may be provided with at least one projected portion projecting toward the internal circuit board. By fixing the projected portion to the internal circuit board in a state inserted into the through hole, mounting of the terminal holder can be easily conducted without employing the soldering work.

In this case, the terminal holder may be formed with a terminal insertion hole into which the small diameter coil spring terminal is inserted and disposed, and an annular groove as the clamping portion may be formed in an end portion of the terminal insertion hole on the side of the internal circuit board. Further, the end portion of the small diameter coil spring terminal on the side of the internal circuit board may be formed as a large diameter portion which has a larger winding diameter than other portions of the small diameter coil spring terminal, so as to be engaged with this annular groove. In this manner, it is possible to reliably hold the small diameter coil spring terminal with a simple structure.

BRIEF DESCRIPTION OF THE DRAWING

These and other objects and advantages of this invention will become more fully apparent from the following detailed description taken with the accompanying drawings in which.

DETAILED DESCRIPTION OF THE PREFERRED EMBODIMENTS

Figure 1:
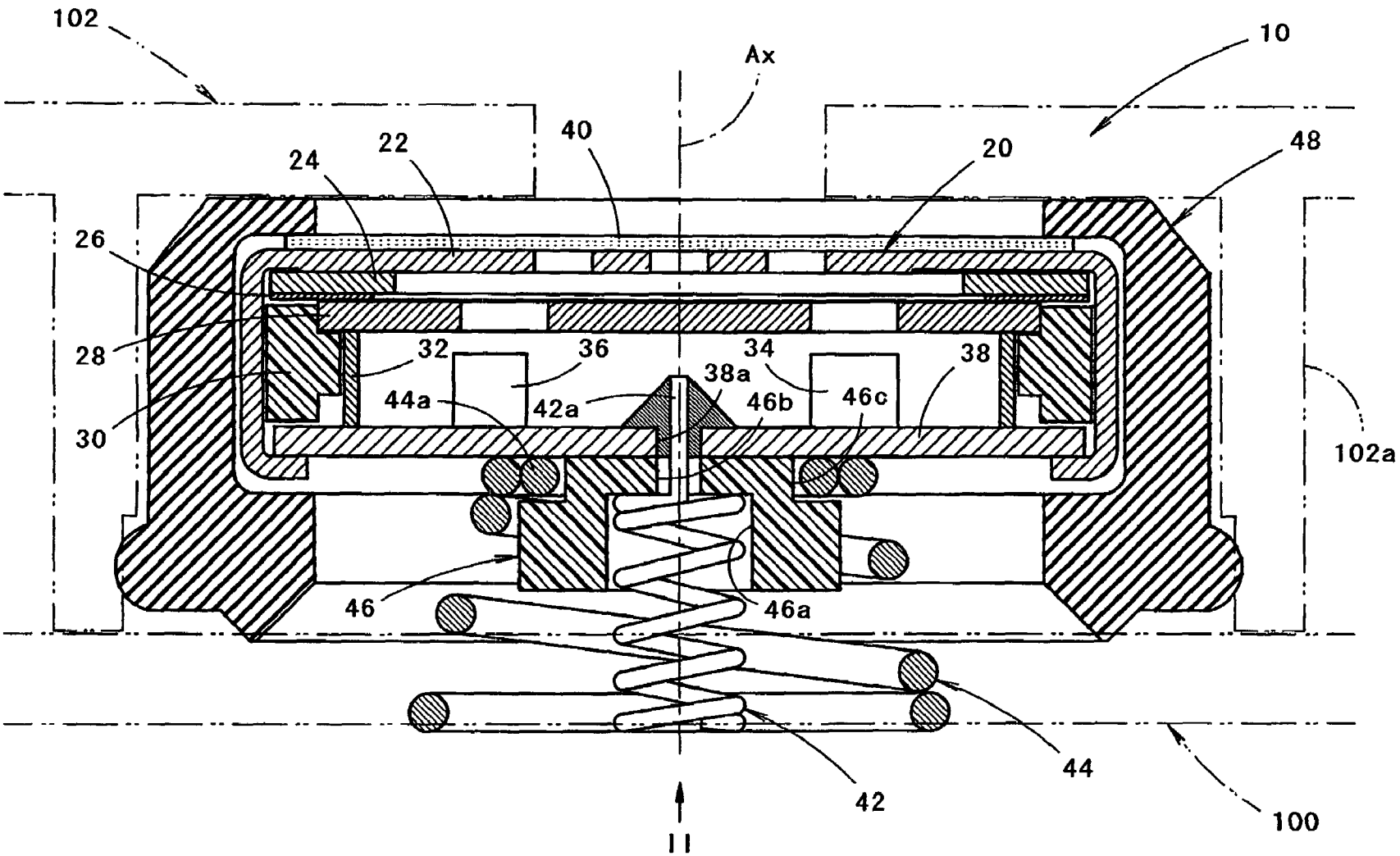
FIG. 1 is a sectional side view showing an electro-acoustic transducer according to a first embodiment of the invention, in an upwardly directed arrangement.

Now, referring to the drawings, embodiments of the present invention will be described.

Hereinafter, a first embodiment of the invention will be described.

Figure 2:
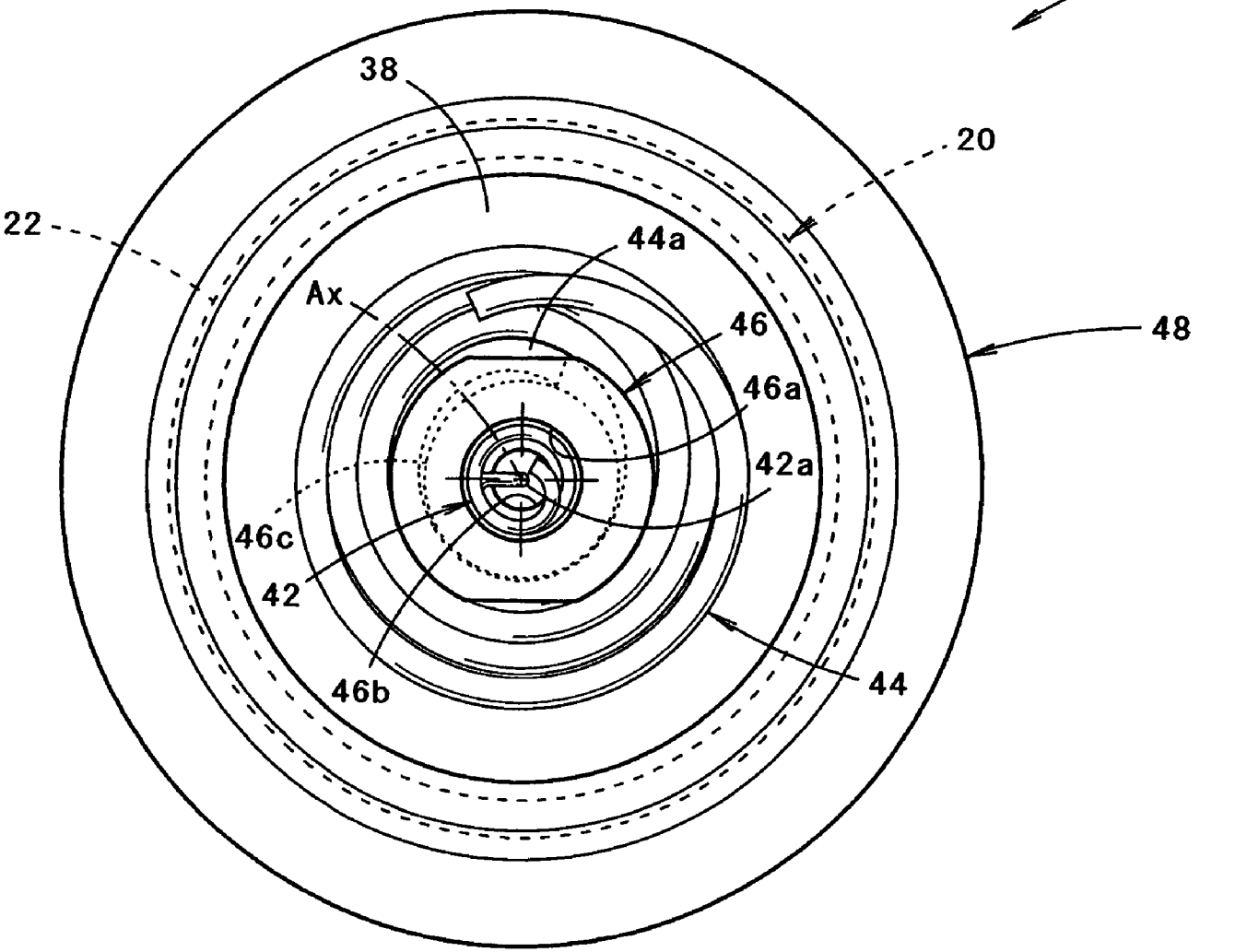
FIG. 2 is a view as seen in a direction of an arrow mark II in FIG. 1.

FIG. 1 is a sectional side view showing an electro-acoustic transducer according to the first embodiment in an upwardly directed arrangement. FIG. 2 is a view as seen in a direction of an arrow mark II in FIG. 1.

As shown in FIGS. 1 and 2, an electro-acoustic transducer 10 according to the first embodiment includes a microphone body 20 configuring a transducer body, which is a miniature electret-condenser microphone, two coil spring terminals 42, 44, a terminal holder 46 and a rubber formed holder 48. The electro-acoustic transducer 10 is configured so as to be mounted on an external circuit board 100 which is a circuit board of an external apparatus (a portable phone, for example.)

The microphone body 20 has a metal cover 22 in a flat cylindrical shape which houses a vibration membrane subassembly 24, a spacer 26, a back electrode plate 28, an insulating bushing 30, a metal ring 32, a field effect transistor 34, a condenser 36 and an internal circuit board 38.

An outer diameter of the metal cover 22 is set to a relatively small value (for example, a value as small as 4 to 8 mm), and a lower end portion of the metal cover 22 is fixed by crimping to an outer circumferential edge of the internal circuit board 38. A filter 40 is mounted to an upper surface of the metal cover 22.

The internal circuit board 38 is a disc-shaped member having substantially the same diameter as an inner diameter of the metal cover 22, and has electrically conductive portions (not shown) of predetermined patterns which are formed on both upper and lower surfaces thereof. The field effect transistor 34 and the condenser 36 are mounted at predetermined positions on the upper surface.

The two coil spring terminals 42, 44 are configure with a small diameter coil spring terminal, and a large diameter coil spring terminal which is arranged in a manner of surrounding the small diameter coil spring terminal. Both the coil spring terminals are arranged in such a manner that their center axes are positioned in line with a center axis Ax of the microphone body 20.

The small diameter coil spring terminal 42 is formed of a compressive coil spring made of metal having a constant winding diameter and a relatively small wire diameter, and a pin-shaped projection 42*a* projecting upward is formed in an upper end portion thereof. On the other hand, the large diameter coil spring terminal 44 is formed of a compressive coil spring made of metal having a winding diameter which is gradually reduced in an upward direction and a relatively large wire diameter. An upper end portion of the large diameter coil spring terminal 44 is designed as a double wound wiring portion in which a small diameter portion 44*a* is additionally formed along an inner circumference thereof.

The terminal holder 46 is an insulating member having a substantially cylindrical outer shape, and mounted to the internal circuit board 38 while holding the two coil spring terminals 42, 44 in such a manner that the center axis of the terminal holder is positioned in line with the center axis Ax of the microphone body 20.

The terminal holder 46 is formed, on its lower end surface and on its center axis, with a terminal insertion recess 46*a*, in which the small diameter coil spring terminal 42 is inserted and disposed. This terminal insertion recess 46*a* is formed in a columnar shape, and has an inner diameter of a slightly larger value than the winding diameter of the small diameter coil spring terminal 42. The terminal holder 46 is further formed, on its upper end surface and on its center axis, with a through hole 46*b* which is communicated with the terminal insertion recess 46*a*. This through hole 46*b* is formed in a columnar shape, and has an inner diameter of a relatively larger value than the wire diameter of the small diameter coil spring terminal 42.

The small diameter coil spring terminal 42 is fixed by soldering to the internal circuit board 38 in a state where the pin-shaped projection 42*a* is inserted into a through hole 38*a*.

The terminal holder 46 is provided with an annular groove 46*c* as a clamping portion, in the upper end portion of its outer peripheral surface. Because of presence of the annular groove 46*c*, the small diameter portion 44*a* which is additionally formed in the upper end portion of the large diameter coil spring terminal 44 is adapted to be clamped between the terminal holder 46 and the internal circuit board 38.

The rubber formed holder 48 is a member for holding the microphone body 20 so as to cover the microphone body 20 substantially in a cylindrical manner, and an inner peripheral surface thereof is formed along an outer profile of the microphone body 20.

The electro-acoustic transducer 10 according to the first embodiment is configured in such a manner that the respective coil spring terminals 42, 44 are elastically compressed and deformed, when it has been mounted on the external circuit board 100, thereby permitting the internal circuit board 38 to be conductive with the external circuit board 100. Meanwhile, mounting of the electro-acoustic transducer 10 on this external circuit board 100 is conducted by mounting the electro-acoustic transducer 10 in advance on a mounting portion 102*a* formed on a cover member 102 of the external apparatus, and then, pressing it to the external circuit board 100.

As described in detail hereinbefore, the electro-acoustic transducer 10 according to the first embodiment is configured so that the terminal holder 46 for holding the two coil spring terminals 42, 44 is fixed to the internal circuit board 38 inside the microphone body 20. Because these two coil spring terminals 42, 44 are designed as the double coil spring terminal, it is possible to mount the electro-acoustic transducer 10 on the external circuit board 100, with no regard to the position of the electro-acoustic transducer 10 in the rotational direction.

Moreover, in the electro-acoustic transducer 10 according to the first embodiment, the terminal holder 46 is formed with the annular groove 46*c* as the clamping portion for clamping the large diameter coil spring terminal 44 between the terminal holder 46 and the internal circuit board 38, in the upper end portion of its outer peripheral surface, and therefore, the large diameter coil spring terminal 44 need not be fixed to the internal circuit board 38. As the results, necessity of fixing by soldering the two coil spring terminals to the internal circuit board one by one, as a conventional art, can be omitted. Accordingly, it will not be necessary to insert the coil spring terminals in the state where the through holes formed at the two positions on the terminal holder and the through holes formed at the two positions on the internal circuit board have been aligned, and mounting workability of the terminal holder 46 can be enhanced.

According to the first embodiment, mounting of the terminal holder 46 can be easily conducted, even in case where the double coil spring terminal structure is employed.

In the first embodiment, the upper end portion of the large diameter coil spring terminal 44 includes the small diameter portion 44*a* which has the smaller winding diameter than other portions of the large diameter coil spring terminal 44 so that the upper end portion of the large diameter coil spring terminal 44 can be engaged with the annular groove 46*c* of the terminal holder 46. Therefore, it is possible to reliably hold the large diameter coil spring terminal 44 with a simple structure.

In this case, the upper end portion of the large diameter coil spring terminal 44 is designed as the double wound winding portion having a winding portion which has a larger diameter than the diameter of the annular groove 46*c*, on the outer circumference of the small diameter portion 44*a*. Therefore, the upper end portion of the large diameter coil spring terminal 44 can be engaged with the annular groove 46*c* without strain.

Moreover, in the first embodiment, the terminal holder 46 and the internal circuit board 38 are formed with the through holes 38*a*, 46*b* respectively, and the small diameter coil spring terminal 42 is provided with the pin-shaped projection 42*a* projecting upward, in the upper end portion thereof. Since this pin-shaped projection 42*a* is fixed by soldering to the internal circuit board 38 in a state where the pin-shaped projection 42*a* is inserted into the through holes 38*a*, 46*b*, the terminal holder 46 can be reliably mounted by conducting a soldering work at one position.

In this case, the terminal insertion recess 46*a* into which the small diameter coil spring terminal 42 is inserted and disposed is formed in the lower end portion of the terminal holder 46 so as to be communicated with the through hole 46*b*, and so, it is possible to prevent the small diameter coil spring terminal 42 from falling accidentally, when the transducer is mounted on the external circuit board 100.

Instead of conducting fixation of the pin-shaped projection 42*a* to the internal circuit board 38 by soldering, as the first embodiment, the fixation can be made by adhesion employing an electrically conductive adhesive agent or the like. In such a case, a tip end of the pin-shaped projection 42*a* may be folded so as not to escape from the through holes 38*a*, 46*b*, to increase the fixing strength more preferably.

Next, a second embodiment of the present invention will be described.

Figure 3:
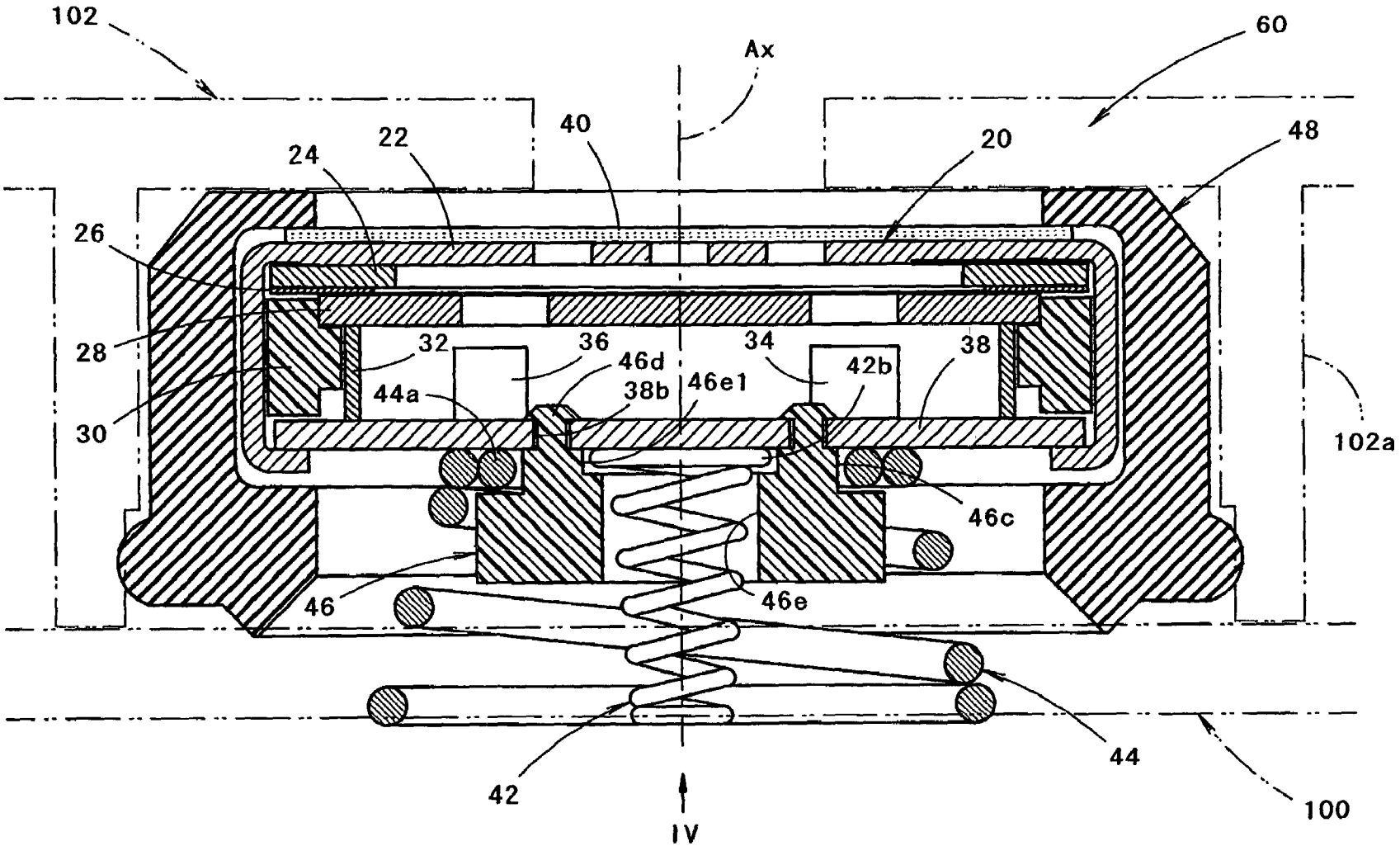
FIG. 3 is a sectional side view showing an electro-acoustic transducer according to a second embodiment of the invention, in an upwardly directed arrangement.
Figure 4:
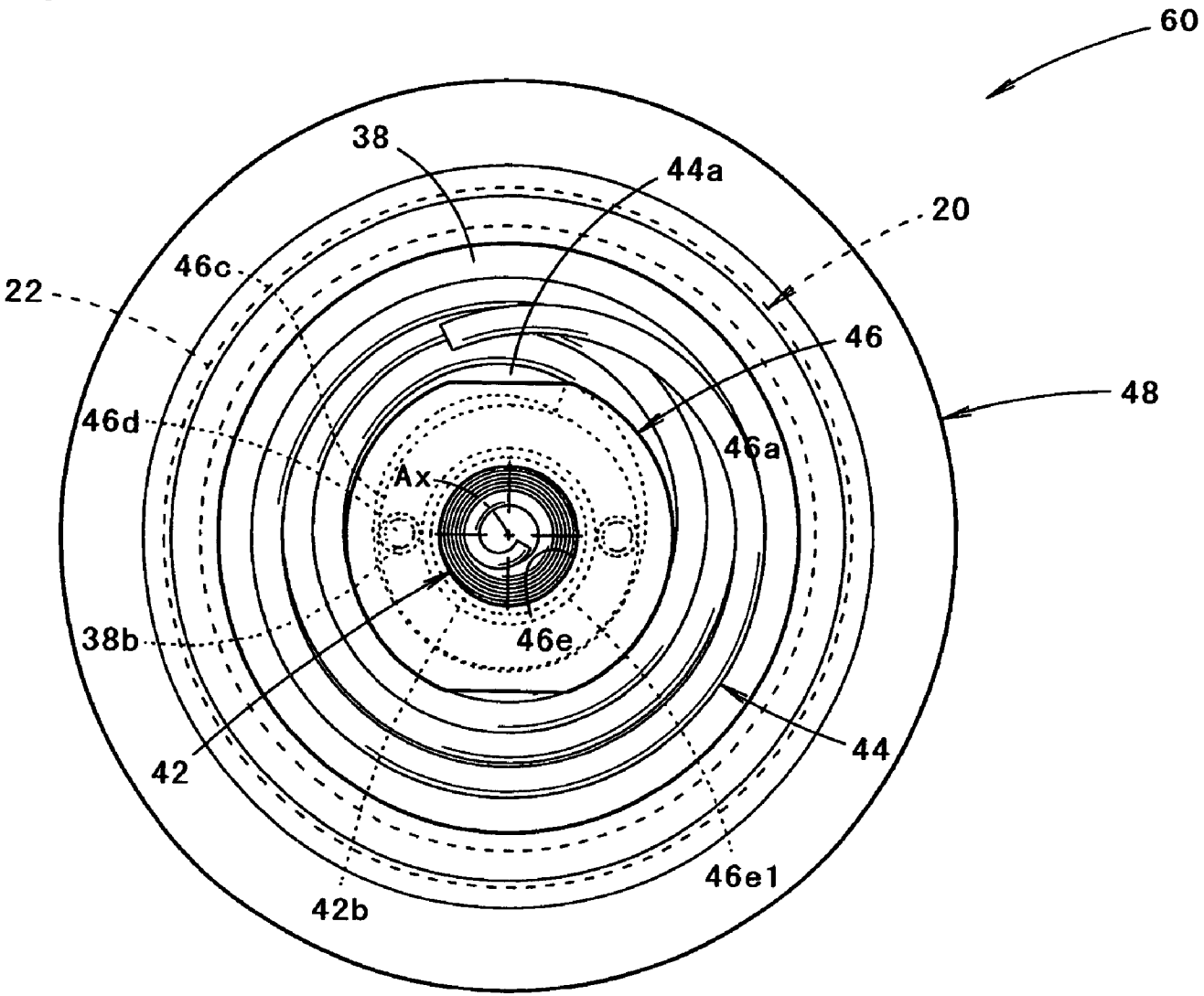
FIG. 4 is a view as seen in a direction of an arrow mark IV in FIG. 3.

FIG. 3 is a sectional side view showing an electro-acoustic transducer according to this embodiment in an upward directed arrangement. FIG. 4 is a view as seen in a direction of an arrow mark IV in FIG. 3.

As shown in FIGS. 3 and 4, an electro-acoustic transducer 60 according to the second embodiment has a basic structure which is substantially the same as the electro-acoustic transducer 10 in the first embodiment, but the structure of mounting the terminal holder 46 to the internal circuit board 38 is different from the electro-acoustic transducer 10 according to the first embodiment. Moreover, the electro-acoustic transducer 60 is different from the electro-acoustic transducer 10 according to the first embodiment in that the terminal holder 46 is provided with not only the clamping portion for the large diameter coil spring terminal 44 but a clamping portion for the small diameter coil spring terminal 42.

Specifically, in the electro-acoustic transducer 60 according to the second embodiment, the internal circuit board 38 is formed with a pair of through holes 38*b* symmetrically with respect to the center axis Ax of the microphone body 20, and the terminal holder 46 is provided with a pair of projected portions 46*d* which are projected upward, at positions corresponding to the pair of the through holes 38*b*. Mounting of the terminal holder 46 to the internal circuit board 38 is conducted by fixing the projected portions 46*d* to the internal circuit board 38 in a state where they have been respectively inserted into the through holes 38*b*.

Fixation of these projected portions 46*d* to the internal circuit board 38 is conducted by heat welding tip ends of the respective projected portions 46*d* to the upper surface of the internal circuit board 38 in a state where the projected portions 46*d* have been respectively inserted into the through holes 38*b*. Then, the through holes 38*b* are closed by this heat welding.

Moreover, the terminal holder 46 is formed with a terminal insertion hole 46*e* into which the small diameter coil spring terminal 42 is inserted and disposed. An annular groove 46*e*1 as the clamping portion is formed in an upper end portion of the terminal insertion hole 46*e*. On the other hand, the upper end portion 42*b* of the small diameter coil spring terminal 42 is formed as a large diameter portion which has a larger winding diameter than other portions of the small diameter coil spring terminal 42, so as to be engaged with the annular groove 46*e*1.

It is to be noted that, in the second embodiment, the small diameter coil spring terminal 42 is formed in such a manner that the winding diameter of the small diameter coil spring terminal 42 becomes gradually smaller toward a lower end portion thereof.

By employing the structure according to the second embodiment, it is possible to easily mount the terminal holder 46 to the internal circuit board 38 without employing the soldering work, and at the same time, it is possible to reliably hold the small diameter coil spring terminal 42 with such a simple structure.

It is also surely possible to fix the projected portions 46*d* of the terminal holder 46 to the internal circuit board 38 by adhesion, instead of fixing them by heat welding, as the second embodiment.

The embodiments have been described referring to the case in which the microphone body 20 is formed in a cylindrical shape, and the internal circuit board 38 is formed in a disc shape. However, in case where the microphone body 20 and the internal circuit board 38 respectively have other shapes than the embodiments, the substantially same advantages as the embodiments can be obtained by forming the substantially same clamping portion as the embodiments on the terminal holder 46.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An electro-acoustic transducer configured so as to be mounted on an external circuit board, comprising:

a transducer body having an internal circuit board;

coil spring terminals which are contactable with a conductive portion of the internal circuit board; and a terminal holder mounted to the internal circuit board so as to hold the coil spring terminals, wherein the electro-acoustic transducer is configured so that the coil spring terminals are elastically compressed and deformed for permitting the internal circuit board to be conductive with the external circuit board when the transducer is mounted on the external circuit board, the coil spring terminals include:

a small diameter coil spring terminal; and a large diameter coil spring terminal arranged in a manner of surrounding the small diameter coil spring terminal, and the terminal holder is provided with at least one clamping portion for clamping one of the coil spring terminals between the terminal holder and the internal circuit board.

2. The electro-acoustic transducer according to claim 1, wherein the clamping portion includes an annular groove formed on an outer peripheral surface of the terminal holder at an end portion on a side of the internal circuit board, and an end portion of the large diameter coil spring terminal on the side of the internal circuit board is formed as a small diameter portion which has a smaller winding diameter than other portions of the large diameter coil spring terminal, such end portion being engaged with the annular groove.

3. The electro-acoustic transducer according to claim 1, wherein the terminal holder and the internal circuit board are respectively formed with a through hole, the small diameter coil spring terminal is provided, in its end portion on the side of the internal circuit board, with a pin-shaped projection projecting toward the internal circuit board, and the pin-shaped projection is fixed by soldering to the internal circuit board in a state where the pin-shaped projection is inserted into both through holes.

4. The electro-acoustic transducer according to claim 2, wherein the terminal holder and the internal circuit board are respectively formed with a through hole, the small diameter coil spring terminal is provided, in its end portion on the side of the internal circuit board, with a pin-shaped projection projecting toward the internal circuit board, and the pin-shaped projection is fixed by soldering to the internal circuit board in a state where the pin-shaped projection is inserted into both through holes.

5. The electro-acoustic transducer according to claim 3, wherein the terminal holder is provided, at its end portion on an opposite side to the internal circuit board, with a terminal insertion recess into which the small diameter coil spring terminal is inserted and disposed in communication with the through hole of the terminal holder.

6. The electro-acoustic transducer according to claim 4, wherein the terminal holder is provided, at its end portion on an opposite side to the internal circuit board, with a terminal insertion recess into which the small diameter coil spring terminal is inserted and disposed in communication with the through hole of the terminal holder.

7. The electro-acoustic transducer according to claim 1, wherein the internal circuit board is formed with at least one through hole, and the terminal holder is provided with at least one projected portion projecting toward the internal circuit board, and the projected portion is fixed to the internal circuit board in a state where the projected portion is inserted into the through hole.

8. The electro-acoustic transducer according to claim 2, wherein the internal circuit board is formed with at least one through hole, and the terminal holder is provided with at least one projected portion projecting toward the internal circuit board, and the projected portion is fixed to the internal circuit board in a state where the projected portion is inserted into the through hole.

9. The electro-acoustic transducer according to claim 7, wherein the terminal holder is formed with a terminal insertion hole into which the small diameter coil spring terminal is inserted and disposed, the clamping portion includes an annular groove formed in an end portion of the terminal insertion hole on the side of the internal circuit board, and an end portion of the small diameter coil spring terminal on the side of the internal circuit board is formed as a large diameter portion which has a larger winding diameter than other portions of the small diameter coil spring terminal, such end portion being engaged with the annular groove.

10. The electro-acoustic transducer according to claim 8, wherein the terminal holder is formed with a terminal insertion hole into which the small diameter coil spring terminal is inserted and disposed, the clamping portion includes an annular groove formed in an end portion of the terminal insertion hole on the side of the internal circuit board, and an end portion of the small diameter coil spring terminal on the side of the internal circuit board is formed as a large diameter portion which has a larger winding diameter than other portions of the small diameter coil spring terminal, such end portion being engaged with the annular groove.

* * * * *